United States Patent [19]

MacDonnell et al.

[11] 3,981,548

[45] Sept. 21, 1976

[54] CONSTANT CONTACT SIDE BEARING

[75] Inventors: Robert W. MacDonnell, Crete; Otto A. Shander, Chicago Heights, both of Ill.

[73] Assignee: R. W. Mac Company, Crete, Ill.

[22] Filed: May 27, 1975

[21] Appl. No.: 580,667

[52] U.S. Cl. ..... 308/226; 105/199 CB; 308/79.1

[51] Int. Cl.[2] ..... B61F 17/00; F16C 1/24; F16C 13/02

[58] Field of Search ..... 105/199 CB; 308/226, 308/79.1

[56] References Cited

UNITED STATES PATENTS

| | | | |
|---|---|---|---|
| 937,752 | 10/1909 | Barber | 308/226 |
| 1,684,509 | 9/1928 | O'Connor | 308/226 |
| 1,990,924 | 2/1935 | Barber et al. | 308/226 |
| 2,142,427 | 1/1939 | Webb | 308/226 |
| 2,169,074 | 8/1939 | Severn | 308/226 |
| 2,329,848 | 9/1943 | Olander | 308/226 |

*Primary Examiner*—M. H. Wood, Jr.
*Assistant Examiner*—Richard A. Bertsch
*Attorney, Agent, or Firm*—J. Patrick Cagney

[57] ABSTRACT

Constant contact side bearings include a base presenting supports for cushions that are engaged by a top follower. In its pre-load position, rollers disposed on the top follower are urged into constant contact with a car body to control truck hunting. The cushions accommodate additional travel of the top follower to provide substantially higher load resistance for control of lateral car body roll resistance.

10 Claims, 7 Drawing Figures

FIG. 6
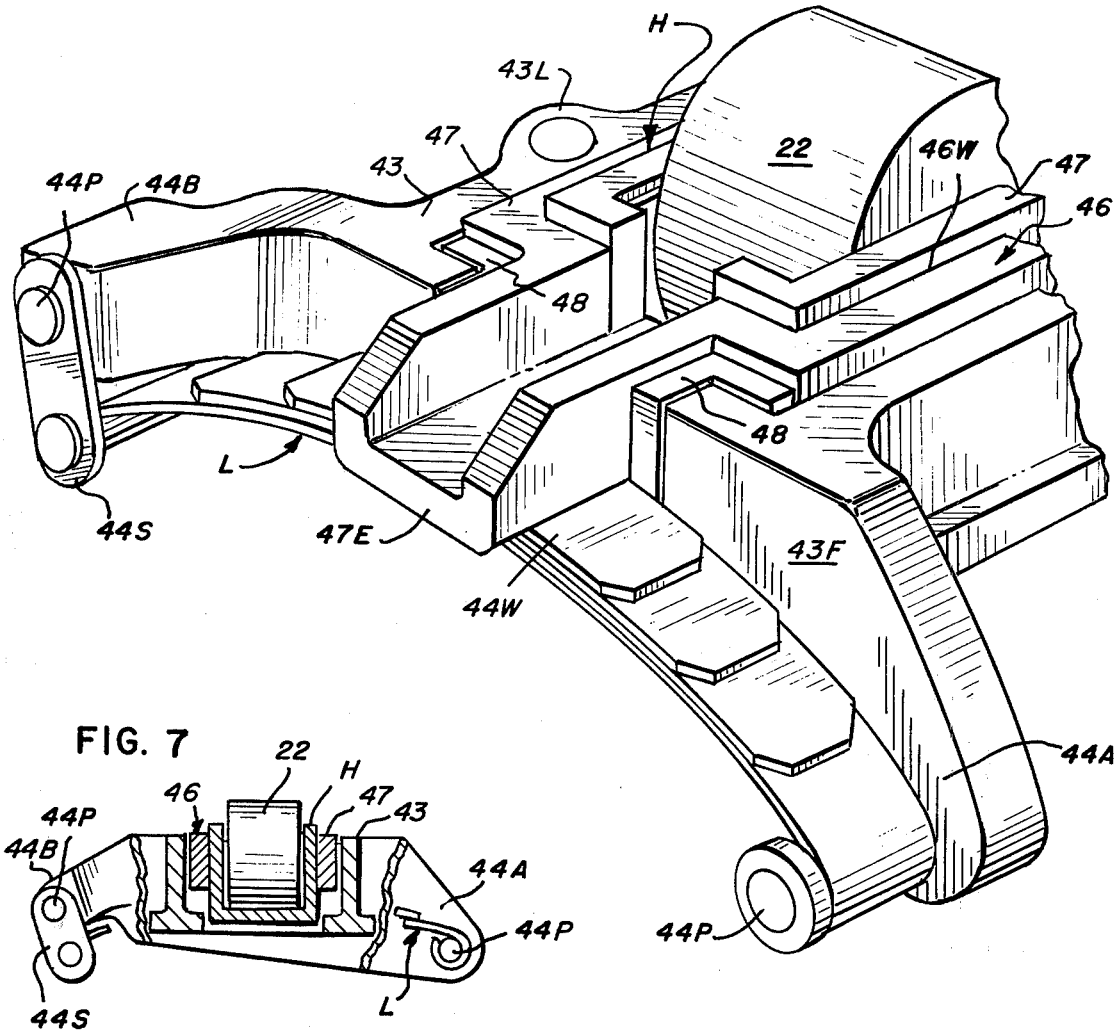
FIG. 7
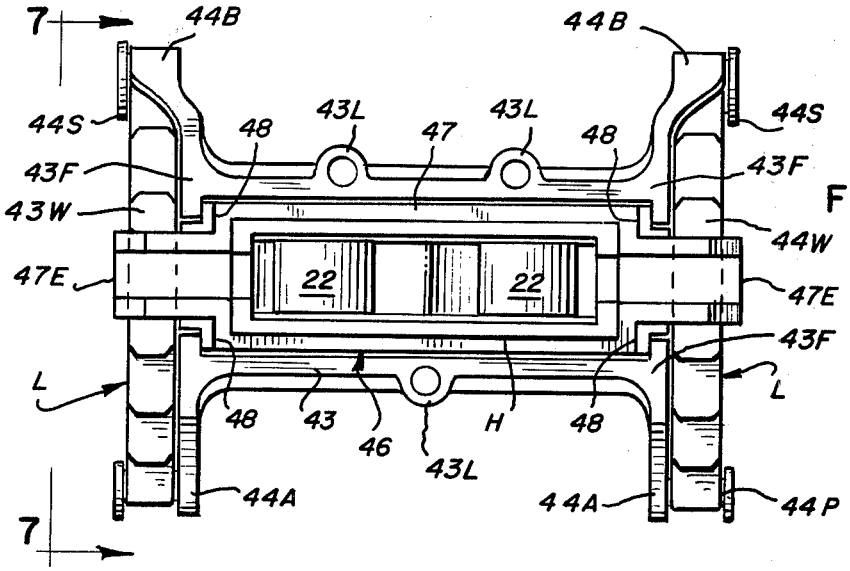
FIG. 5

CONSTANT CONTACT SIDE BEARING

BACKGROUND OF THE INVENTION

Generally, this invention relates to truck control systems for railway cars and more particularly this invention relates to constant contact side bearings for railway car trucks.

Two of the major truck control problems are truck hunting and lateral car body roll or rock and roll.

Truck hunting results from unrestrained fore and aft swiveling and can be set up by the normal rail following motion of the trucks on a car operating at light load and high speed as it follows the rails through a curve. Uncontrolled truck hunting causes flange wear and contributes to "nosing" resulting in overall wear of the truck parts and ultimately leading to derailment should the wheel flange climb the rail.

Lateral car body roll occurs in the case of heavily loaded cars operating on uneven road beds. Lateral car body roll usually results in impact contact between the bolster gibs the truck side frame. The lateral role condition is believed to occur in the following sequence:

1st., initial lateral car movement resulting from typical center plate clearances;

2nd., followed by a compression pivoting movement where the truck springs go solid at a tip angle of 18°;

3rd., followed by closing the nominal clearance between the body and bolster side bearings;

4th., and finally a lunging motion as the car body continues its roll angle until the bolster gibs contact the side frame columns — this high impact contact is the main truck damage problem associated with lateral car body roll.

Many designs of constant contact type side bearings have previously been employed but none of these has satisfactorily handled both truck hunting and lateral car body roll. If the side bearing is unduly stiff, it will eliminate truck hunting but at the expense of impairing the ability of the truck to swivel as required as it enters a curve and for returning to normal as it exits from a curve. If the side bearings is too soft, in order to accomodate free truck swiveling as required for following a curve, it will not adequately control truck hunting and it will be largely ineffective in controlling lateral car body roll.

SUMMARY OF THE INVENTION

The present invention provides that a truck control system which is adaptable either for existing railway car trucks, for new standard car trucks or for modified car trucks and which is capable of controlling truck hunting without impairing the desired free swiveling and which is also capable of restricting lateral car body roll to reduce contact between the bolster gibs and truck side.

Thus the invention provides side bearing arrangements that may be embodied as add or units for existing truck bolsters or that may be embodied as integral cast units for new bolsters.

More particularly, the invention contemplates a side bearing for providing constant contact between a truck bolster and a railway car body and comprising base means rigid with the bolster and providing cushion supports flanking the bolster, cushioning means carried by the supports, top follower means bridging the bolster and supported on the cushioning means to undergo cushioned vertical travel above and below the preload position, the top follower means having an upwardly facing pocket overlying the bolster and defining an elongate raceway extending intermediate the cushioning means, and roller means disposed in the pocket in constant contact rolling engagement between the raceway and the car body.

In the case of coil spring type cushioning embodiments intended for modified car truck designs; for lighter duty applications, the base means is arranged to present a single vertical cylinder at each side of the bolster, and for heavier duty applications, the base is arranged to present a pair of laterally, oppositely inclined cylinders flanking the bolster at each side and containing cushioning means acting at lateral angles to continuously provide lateral centering and lateral car body roll resistance.

In a leaf spring embodiment that is compatible with existing or new standard car trucks, the flanking mounting relationship of the leaf springs maximizes the cushion resistance within the presently available clearances.

Cushioning means are provided to operate at a relatively low spring rate during deflection to the pre-load position to prevent truck hunting and to operate at a relatively high spring rate during deflection beyond preload position to exert lateral car body roll resistance. In one of the disclosed embodiments, the cushioning means comprises inner and outer coil springs, the outer coil spring having a greater free height to act primarily for determining the preload level for control of truck hunting and the inner coil spring having a greater spring rate to act primarily as the lateral roll, anti-wheel lift control.

In the preferred embodiments disclosed herein, the top follower pocket has first and second successive raceway sections each having a separate roller therein to equalize load distribution between the cushioning means and a lateral thrust plate disposed in the pocket outboard of the rollers. In addition the top follower and the base have vertically spaced confronting surfaces engagable in positive stop relation to limit compression of the cushioning means, and the base and the top follower have vertically overlapping walls interengageable to limit transverse movement therebetween.

Other features and advantages of the invention will be apparent from the following description and claims and are illustrated in the accompanying drawings which show structure embodying preferred features of the present invention and the principles of applying the same.

BRIEF DESCRIPTION OF THE DRAWINGS

In the accompanying drawings forming a part of the specification and in which like numerals are employed to designate like parts throughout the same;

FIG. 5 is a top plan view of a spring leaf side bearing embodiment that is adaptable to available clearances of existing truck arrangements;

FIG. 6 is a fragmentary perspective view of the spring leaf side bearing embodiment of FIG. 5; and FIG. 7 is an end view, partly in section, taken approximately as indicated on the line 7—7 of FIG. 5.

SPECIFIC DESCRIPTION OF PREFERRED EMBODIMENTS

Figure 2:
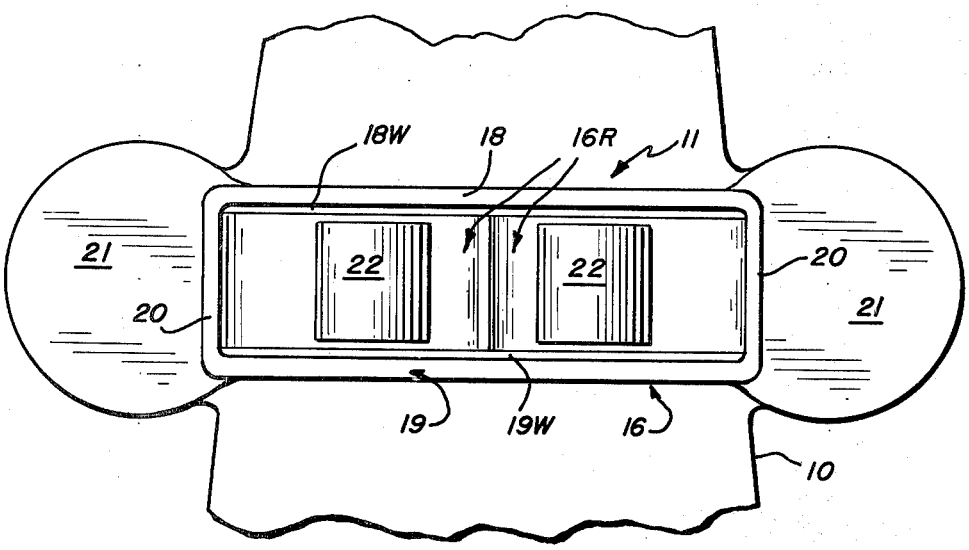
FIG. 2 is a top plan view of the side bearing of FIG. 1.
Figure 1:
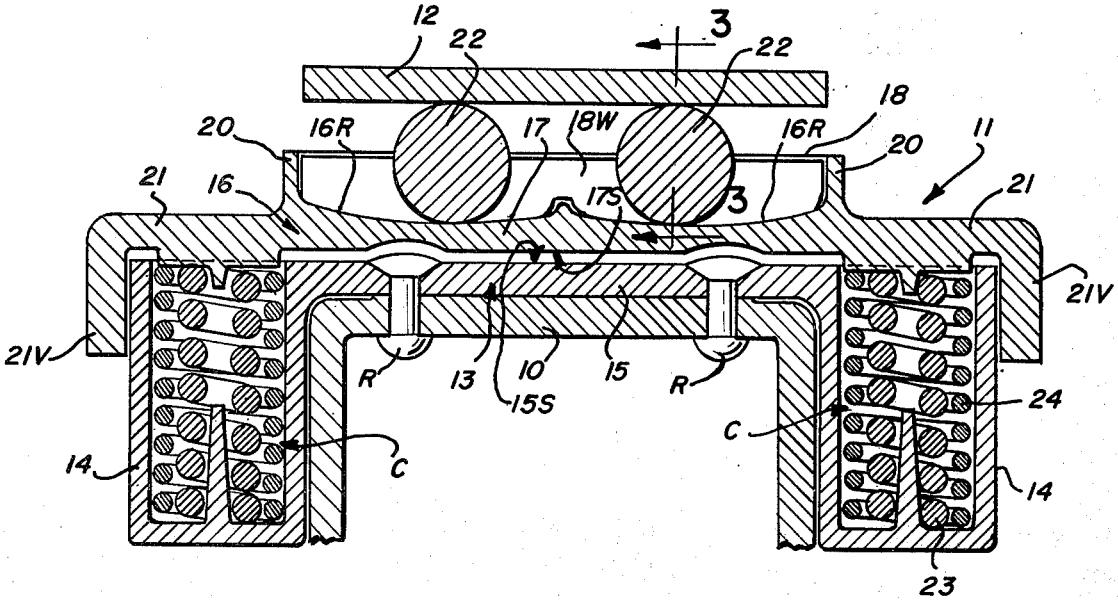
FIG. 1 is a vertical section showing an addon type of constant contact side bearing arrangement applied to a bolster with the parts being illustrated in the preload position.
Figure 3:
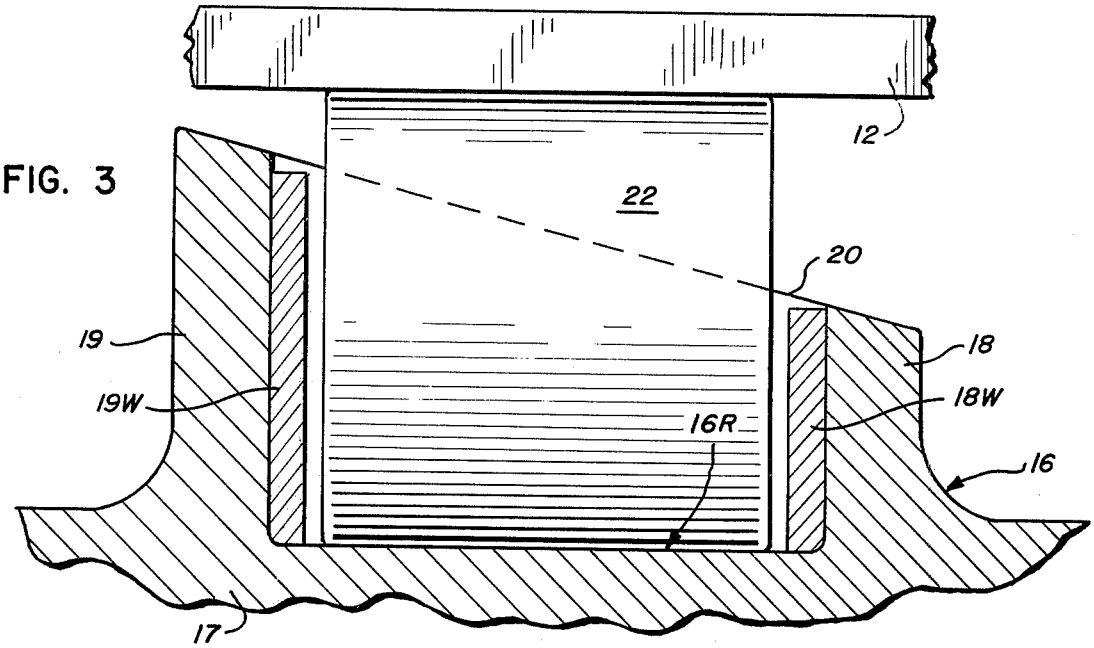
FIG. 3 is a fragmentary section taken on the line 3—3 of FIG. 1.

Referring now to the drawings, a side bearing arrangement of the vertical cylinder add-on type is shown in FIGS. 1 and 2 as applied to a conventional bolster 10 of a modified car truck. Typically, the bolster includes a set of holes in its top wall for receiving mounting rivets R. The side bearing unit 11 is arranged to be located and applied in the same place and in the same way as any conventional side bearing without requiring shimming or adjusting.

The side bearing unit 11 of FIGS. 1 and 2 is illustrated as providing constant contact between the truck bolster 10 and the usual car body side bearing wear plate 12.

The side bearing unit includes a base structure 13 held rigid with the bolster by the rivets R and providing cushion supports 14 in the form of mounting chambers flanking the bolster and opening toward the car body to receive cushioning means C. In the illustrated add-on type construction the base has a top crosswall 15 provided with counter sunk holes for mounting rivets R, the crosswall 15 spanning the width of the bolster to carry the mounting chambers in cantilever fashion. Limited clearance can be provided between the bolster walls and the vertical cylinder portions that define the mounting chambers to accomodate dimension variances in the case of the existing bolsters.

A top follower 16 bridges the bolster and is supported on the cushioning means to undergo cushioned vertical travel above and below the pre-load position in which the parts are illustrated in FIG. 1. The top follower 16 has an upwardly facing pocket overlying the bolster 10 and defining an elongated raceway extending intermediate the cushioning means C. Thus, the top follower 16 is a one piece casting having a main horizontal wall 17 provided with integrally upstanding inboard and outboard lengthwise walls 18,19 respectively, interconnected by end walls 20. The outboard wall 19 is higher to withstand lateral thrust forces applied outwardly through the rollers 22 as part of the typical movement sequence associated with lateral car body roll conditions. A substantially full-length full height wear plate 19 W is fixed to the outboard wall to be engaged by the rollers and handle the relatively higher wear rate applied in the outboard direction. If desired, a wear plate 18W is also used along the shorter inboard wall 18 though the wear conditions are much less severe. The main wall 17 carries integrally connected follower portions 21 that seat in floating relation to the upper ends of the cushioning means, the follower portions including vertical skirt portions 21V overlapping the upper ends of the vertical cylinder walls to interengage therewith in limiting lateral transverse movement between the follower 16 and the base 13.

In accordance with the preferred practice of the invention, the main wall 17 of the top follower 16 is provided with a race way arranged as first and second successive sections 16R, with a separate roller 22 disposed in each race way section to equalize load distribution between the cushioning means C. The roller and race way arrangements may be of any conventional type but since the rollers 22 are employed in a constant contact type side bearing arrangement, it is preferred that each race way section 16R have a flat central region flanked by oppositely inclined surfaces of equal curvature so that the rollers will not always act as exactly the same point.

It should be noted that the embodiment of FIGS. 1 and 2 which utilizes a single vertical cylinder at each side of the bolster is particularly suited for lower capacity cars which may originally be equipped with a short wear plate such as is employed for single roller types of prior art side bearings. It is preferred that the short wear plate be removed and replaced with a wear plate long enough to accomodate a double roller arrangement is contemplated within the general features of this invention, it is not preferred because of the tendency of the top follower plate to cock and produce unequal loading of the cushioning units.

It should be noted that the cushion supports 14 are disposed to straddle the bolster 10 to accomodate sufficient vertical clearance between the car body wear plate 12 and the bolster for mounting the rollers 22 that enable low friction swivel movement of the truck, with the rollers 22 being mounted on the floating top follower 16 to exert constant contact engagement with the car body wear plate at a load level sufficient to prevent hunting without impairing swiveling when the parts are at the pre-load position as illustrated at FIG. 1. The top follower 16 is capable of downward movement from the preload position to further compress the cushioning means C and develop substantially greater load resistance capable of controlling lateral car body roll. It will be noted that the main wall 17 of the top follower and the main wall 15 of the base have vertically spaced confronting surfaces 17S,15S that are engageable in positive stop relation to prevent the cushioning means C from going solid in the presence of high energy lateral roll conditions.

The cushioning means C as illustrated in FIG. 1 comprises inner and outer coil springs 23,24 respectively, in an arrangement wherein the outer coil spring 24 has a greater free height to be the primary factor in determining the spring force acting at the pre-load position for preventing hunting and with the inner coil spring 23 having a greater spring rate to be the primary factor in determining the lateral car body roll resistance developed by the unit. Thus, at the pre-load height for the coil springs shown in FIG. 1, the outer spring 24 is loaded and the inner spring 23 is in contact but is not under any substantial load. Typically, the outer spring 24 may have a free height of 1 ½ inches, a solid height of 7 inches, a wire size of ⅜ inch diameter and a spring rate of 1,250 pounds per inch and the inner spring may have a free height of 7 ½ inches, a solid height of 7 inches, a wire size of ½ inch diameter and a spring rate of 40,000 pounds per inch. Thus, for a pre-load height where a ⅜ inch clearance exists between the confronting surfaces 17S,15S of the follower and the base, the outer spring is at a deflection of 2 inches and develops a load of 2,500 pounds. The maximum load developed by each set of inner and outer springs before the side bearing parts go solid is 18,125 pounds.

It should be noted that the ⅜ inch clearance provided at the pre-load height develops sufficient load resistance to reduce the frequency of contact between the bolster gibs and the truck side and to reduce such impacts as do occur to a level that significantly minimizes damage to the truck parts and the lading.

To illustrate the action of the unit in controlling truck hunting it will be noted that the roller action of the present constant contact side bearing arrangement is like that of the prior art roller type side bearings when the prior art rollers are engaged. As the car stands on normal track, the rollers 22 are at the the neutral or center positions in the race ways as illustrated in FIG. 1. As the car enters a curve, the truck swivels in following the rail to cause both rollers on one side to move forward and both rollers on the other side to move back of the neutral point. As the rollers are elevated during such movement, the resistance to swiveling of the truck automatically increases, however, the low co-efficient of friction provided by the roller system under constant contact load conditions assures that the truck will be recentered by the action of the rollers going back down the inclines when the truck leaves the curve.

For increased lateral roll effect, the cushioning means C may include energy absorbing devices such as snubbers mounted in the cushioning chambers. Any suitable type of existing snubber may be employed for preventing the possibility of harmonic buildup of energy.

Figure 4:
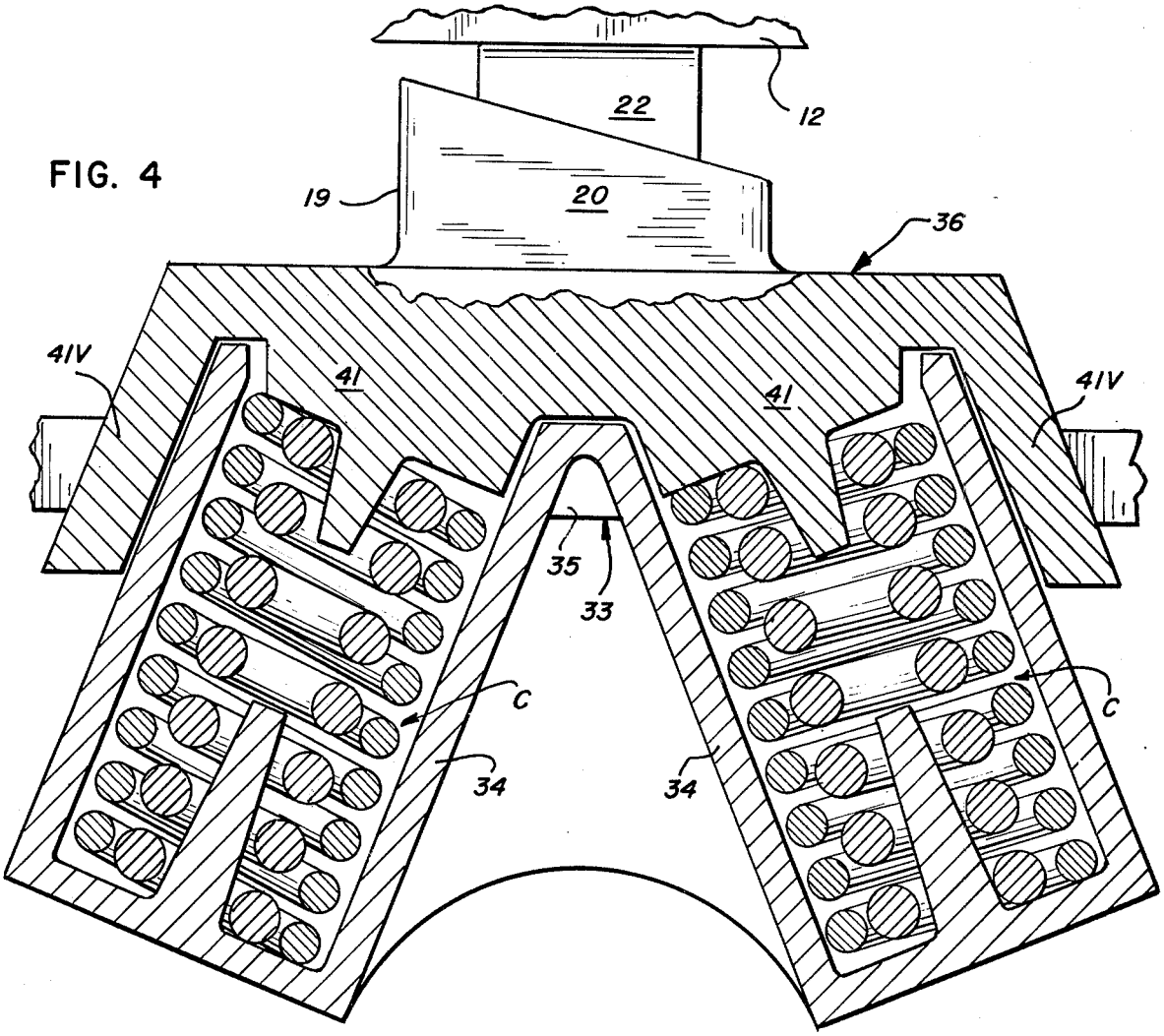
FIG. 4 is a partly elevational, partly vertical sectional view illustrating another embodiment utilizing double lateral angle cylinders on each side of the bolster, with the parts being shown in the solid height position.

For higher capacity cars where a modified car truck design is available to afford the necessary mounting clearance it is preferred to utilize a side bearing arrangement wherein the base 33 includes cushion supports consisting of a pair of laterally, oppositely inclined cylinders 34 flanking the bolster at each side as shown in FIG. 4. Each cylinder contains cushioning means C acting at a vertical angle of approximately 21.5° when the unit is at the pre-load position to continuously provide a lateral centering and lateral roll resistance. The preferred angle value is given here for purposes of disclosure and while it is not critical, it may be noted that a vertical angle of 30° or more is not suitable for coil springs and leads to destruction of the springs.

The side bearing of FIG. 4 is otherwise generally similar to the embodiment of FIGS. 1 and 2 in that it is of the add-on type and the base 33 includes a main cross wall 35 seated on the bolster and carrying the cylinders 34. The top follower 36 bridges the bolster and is supported on the pairs of cushioning means c disposed at each side of the bolster. The main horizontal wall of the follower has similar inboard and outboard longitudinal walls 18,19 connected by end walls 20 to define a raceway pocket for the rollers 22. Follower portions 41 for the cushioning means are provided with skirt portions 41V that overlap the upper ends of the cylinders 34 in limiting lateral transverse movement between the follower 36 and the base 33.

The FIG. 4 embodiment is shown in the solid height position wherein the confronting surfaces of the main walls of the follower and base are engaged in positive stop relation to prevent the cushioning means C from going solid.

With the double angle configuration, the side bearing of FIG. 4 affords immediate lateral centering control during the initial stage of the typical lateral roll sequence of the car body. Thus, as soon as the car body starts to move laterally due to center plate clearances, it is opposed by the centering forces associated with the double angle springs. Lateral centering control is developed both from the loaded side bearing and from the unloaded side bearing because of the constant contact relationship. In addition, even after the lateral roll causes closing of the loaded side bearing, the unloaded side bearing continues to supply a centering action. Thus, the double sets of angle springs in each side bearing unit work against each other at an angle selected to maximize the lateral centering action while at the same time the springs in the side bearing units on both sides of the truck work in unison to control truck hunting in the manner previously described.

Each of the side bearing embodiments shown in FIGS. 1 to 4 is of the add on type suitable for existing bolsters, however, modifications of the truck would be required to insure adequate brake beam clearances.

The side bearing embodiments are particularly intended for use in new bolsters wherein the base structure is formed integrally with the bolster. Integral construction importantly increases the beam strength of the bolster at the side bearing region to improve the arrangement's ability to withstand the additional stresses due to the high lateral roll forces that the side bearing is intended to handle.

The integral construction also affords greater clearance (for example, the thickness of the wall 15 in FIG. 1 can be eliminated) to permit use of 4 inch rollers in place of the 3 inch rollers 22 shown in FIG. 1.

For existing bolster and car truck arrangements, the embodiment of FIGS. 5 to 7 is compatible with the existing clearance relationships. This embodiment includes a base 43 having lugs 43L registering with existing holes for securement to the bolster by rivets. At each side of the bolster, the base 43 has an elongated depending flange 43F each terminating in spaced supports 44A,44B at its opposite extremities.

Each of the cushioning means L is in the form of a leaf spring assembly extending alongside the bolster. Each leaf spring assembly L has its outboard end pivoted on a fixed pin 44P provided in the support 44A and has its inboard end pivoted on a shackle 44S pivoted on a fixed pin 44P in the support 44B. A wear plate 44W is secured to the leaf spring assembly at its central crest region to serve as a sliding support seat for the top follower structure. When the leaf spring is loaded to deflect it from its upwardly bowed configuration, the shackle 44S acts as a floating support to accommodate lateral extension of the inboard end of the leaf spring assembly.

The top follower structure 46 bridges the bolster and is supported on the leaf spring assemblies by contact with the wear plates 44W. The top follower arrangement as disclosed here is compatible with the Stucki side bearing housings that are provided on many of the existing trucks. The conventional Stucki type housing is designated at H and is seated in the central opening of a generally rectangular hollow central frame portion 47 that forms a part of the top follower structure 46. The frame portion 47 has offset end portions 47E that ride on the wear plates 44W as previously described.

The Stucki housing H is shown equipped with the conventional rollers 22 but in this arrangement the leaf spring assemblies L hold the top follower structure so that the rollers are in constant contact with the car body wear plate. The housing H is inserted full depth into the follower frame 46 and these parts are fixed by weld 46W to locate their bottom surfaces flush for simultaneous positive stop contact with the top wall of the bolster.

Angle type wear plates 48 are provided at the 4 corner regions between the frame 46 and the base flanges 43F.

The leaf springs apply the constant contact force at the pre-load position for preventing hunting and also provide additional force to resist follower movement below the preload position during the existence of lateral roll conditions.

Thus, while preferred constructional features of the invention are embodied in the structure illustrated herein, it is to be understood that changes and variations may be made by those skilled in the art without departing from the spirit and scope of the appended claim.

What is claimed is:

1. A side bearing for providing constant contact between a truck bolster and a railway car body and comprising base means rigid with the bolster, and providing cushion supports flanking the bolster cushioning means carried by said supports, top follower means bridging said bolster and supported on said cushioning means to undergo cushioned vertical travel above and below a pre-load position, said top follower means having an upwardly facing pocket overlying the bolster and defining an elongated raceway extending intermediate said cushioning means, and roller means disposed in said pocket in constant contact rolling engagement between the raceway and the car body.

2. A side bearing as defined in claim 1 wherein said raceway includes first and second successive raceway sections and said roller means includes a separate roller disposed in each raceway section to equalize load distribution between said cushioning means.

3. A side bearing as defined in claim 1 wherein a lateral thrust plate is disposed in said pocket outboard of said roller means.

4. A side bearing as defined in claim 1 wherein said base means and said top follower means have vertically overlapping walls interengageable to limit relative transverse movement therebetween.

5. A side bearing as defined in claim 1 wherein said base means and said top follower means have vertically spaced confronting surfaces engageable in positive stop relation to limit compression of said cushioning means.

6. A side bearing as defined in claim 1 wherein said supports of said base means comprise substantially vertical cylinders defining substantially vertical mounting chambers for said cushioning means.

7. A side bearing as defined in claim 1 wherein said supports of said base means comprises a pair of laterally oppositely inclined cylinders flanking the bolster at each side, each cylinder containing cushioning means acting at a lateral angle to continuously provide lateral centering and lateral car body roll resistance.

8. A side bearing as defined in claim 1 wherein each cushioning means operates at a relatively low spring rate during deflection to preload position to prevent truck hunting and operates at a relatively high spring rate during deflection beyond preload position to exert lateral car body roll resistance.

9. A side bearing as defined in claim 1 wherein each cushioning means comprises inner and outer coil springs, the outer coil spring having a greater free height to determine the spring force at preload for preventing hunting and the inner coil spring having a greater spring rate to exert greater lateral car body roll resistance.

10. A side bearing as defined in claim 1 wherein each cushioning means comprises a leaf spring assembly, said base means includes a pair of spaced supports flanking the bolster at each side to engage opposite ends of the corresponding leaf spring assembly and mount the same in resiliently supporting relation to the corresponding end of the top follower means.

* * * * *